United States Patent [19]

Tanaka

[11] Patent Number: 4,914,683

[45] Date of Patent: Apr. 3, 1990

[54] ANODE DRIVING APPARATUS OF ROTATING ANODE X-RAY TUBE

[75] Inventor: Shigeru Tanaka, Ootawara, Japan

[73] Assignee: Kabushiki Kaisha Toshiba, Kawasaki, Japan

[21] Appl. No.: 116,798

[22] Filed: Nov. 5, 1987

[30] Foreign Application Priority Data

Nov. 19, 1986 [JP] Japan ..... 61-277100

[51] Int. Cl.[4] ..... H05G 1/56

[52] U.S. Cl. ..... 378/114; 378/101; 378/115; 378/117

[58] Field of Search ..... 378/101, 114, 115, 117; 361/3, 6, 166, 187

[56] References Cited

U.S. PATENT DOCUMENTS

| | | | |
|---|---|---|---|
| 2,185,826 | 1/1940 | Atlee . | |
| 3,456,175 | 7/1969 | Bavor . | |
| 4,170,735 | 10/1979 | Codina et al. | 378/110 |
| 4,458,193 | 7/1984 | Jonsson . | |
| 4,585,985 | 4/1986 | Bose . | |
| 4,672,288 | 6/1987 | Abbondanti . | |

*Primary Examiner*—Carolyn E. Fields
*Assistant Examiner*—David P. Porta
*Attorney, Agent, or Firm*—Finnegan, Henderson, Farabow, Garrett, & Dunner

[57] ABSTRACT

An anode driving apparatus of a rotating anode X-ray tube includes a power source transformer connected to an AC power source, first and second taps, located at the secondary winding of the power source transformer, for outputting first and second AC voltages having the same phase, first and second switching elements respectively connected to the first and second taps and each made up of a solid state relay (SSR), an AC motor having a common terminal commonly connected to the first and second switching elements, a main terminal connected to a 0-voltage terminal of the power source transformer, and a subterminal connected to the 0-voltage terminal of the power source transformer via a phase shift capacitor, and a switching controller for turning on/off the first and second switching controller sequentially and continuously turns on the first and second switching elements, and sequentially applies the first and second AC voltages to the common terminal of the AC motor. When generation of the rotate signal is stopped, the switching controller periodically turns on/off the first switching element, at the same frequency as that of the first AC voltage, to half-wave rectify the first AC voltage, and applies a braking voltage to the common terminal of the AC motor.

8 Claims, 5 Drawing Sheets

ANODE DRIVING APPARATUS OF ROTATING ANODE X-RAY TUBE

BACKGROUND OF THE INVENTION

The present invention relates to an anode driving apparatus of a rotating anode X-ray tube.

In general, an X-ray tube used in an X-ray CT apparatus must radiate X-rays continuously while it is rotating around a subject being examined. Therefore, if electrons from a cathode are continuously radiated only onto a single spot on the target of an anode, the target will eventually melt. For this reason, the anode is provided with an inclined target and is rotated at a constant speed, thereby preventing radiation of electrons from the cathode solely onto a single spot on the target.

FIG. 1 shows a conventional driving apparatus for a rotating anode of such an X-ray tube. In FIG. 1, secondary winding T (output side) of a power transformer is provided with three taps, three voltages (AC voltages-)—of 220 V, 110 V, and 60 V—being output therefrom, respectively. The voltage of 220 V is used during activation, wherein the anode in a static state is made to begin rotating, the voltage of 60 V is a driving voltage used to keep the anode rotating at a constant speed, and the voltage of 110 V is a braking voltage used to stop the rotation of the anode. The driving voltages of 220 V and 60 V are mechanically switched by a switching circuit constituted by three electromagnetic relays Ry1, Ry2, and Ry3, in accordance with a selected one of two modes, i.e., an activation mode and a constant-speed rotation mode, and are applied to common terminal C of an AC motor (not shown) for rotating the anode. The braking voltage of 110 V is rectified through a full-wave rectifier consisting of diode bridge circuit STACK 1 and is then supplied to main terminal M of the AC motor via two relays, Ry2 and Ry3, and to subterminal S further via phase-shift capacitor C1.

The switching of relays Ry1 to Ry3 is controlled in association with a rotate signal supplied from an external circuit (not shown), as is shown in FIG. 2. In this case, assume that each electromagnetic relay is in an ON state and its contact is connected to a terminal indicated by a white dot when the level of FIG. 2 is high level.

In this conventional apparatus, electromagnetic relays are used to switch the driving and braking voltages to be applied to the AC motor. Therefore, an arc is generated, which is turn generates a surge dependent on a voltage phase whenever the voltage is switched (i.e., since an AC voltage is used, an arc is not generated when a phase is 0 but is generated when the phase is other than 0). In this case, the electromagnetic relays become a large noise source with respect to other circuits. Moreover, each time a surge is generated, this causes damage to, and a gradual wearing away of the relay contract, with the result that the electromagnetic relays must be replaced periodically.

In addition, the braking voltage is rectified by a special rectifier separate from a circuit for the driving voltage. Since additional space must be provided to house the rectifier, this results in an apparatus which is quite bulky.

SUMMARY OF THE INVENTION

It is therefore an object of the present invention to provide an anode driving apparatus of a rotating anode X-ray tube, which can prevent the generation of surges during alternate switching between driving and braking voltages, and thereby prevent generation of noise.

It is another object of the present invention to provide an anode driving apparatus of a rotating anode X-ray tube, which does not require periodic replacement of electromagnetic relays.

According to the present invention, there is provided an anode driving apparatus of an X-ray tube having a rotating anode, which comprises a motor for rotating the rotating anode, a power source for generating a first AC voltage for activation and a second AC voltage for constant-speed rotation, a switching circuit connected between the power source and the motor, and having a zero-crossing switching function, and a control circuit for switching the switching circuit in a predetermined order, to sequentially apply the first and second AC voltages to the motor.

DETAILED DESCRIPTION OF THE PREFERRED EMBODIMENT

Embodiments of an anode driving apparatus of a rotating anode X-ray tube according to the present invention will now be described below, with reference to the accompanying drawings.

Figure 1:
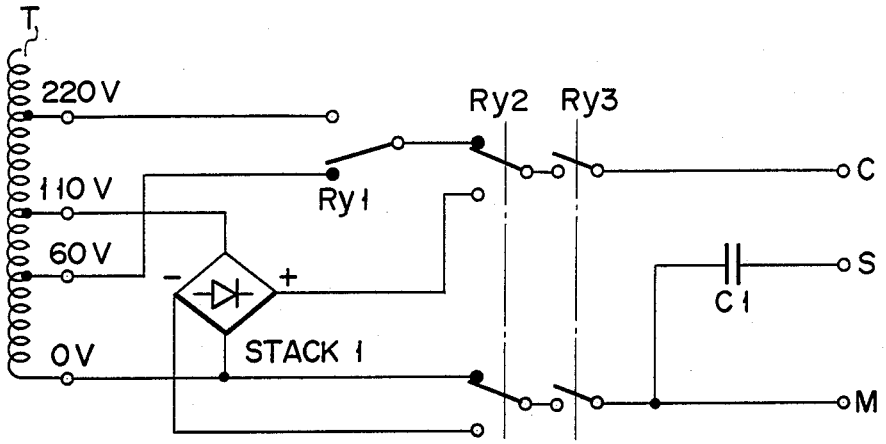
FIG. 1 (PRIOR ART)
FIG. 1 is a block diagram of a conventional rotating anode driving apparatus of a rotating anode X-ray tube.
Figure 2:
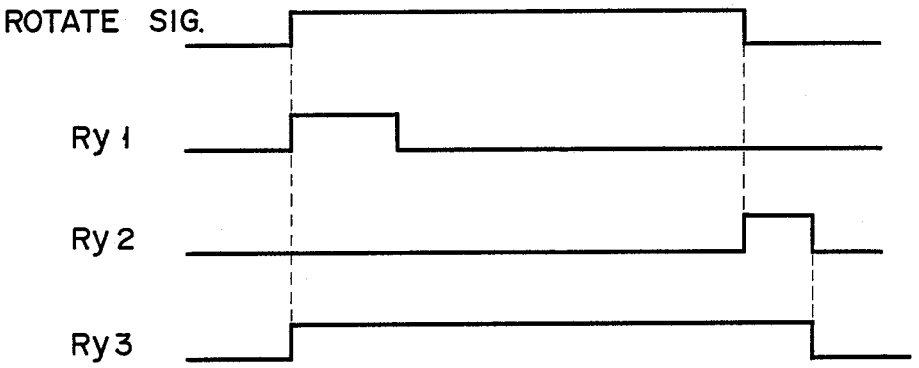
FIG. 2 (PRIOR ART)
FIG. 2 is a timing chart for explaining the overall operation of the apparatus shown in FIG. 1.
Figure 3:
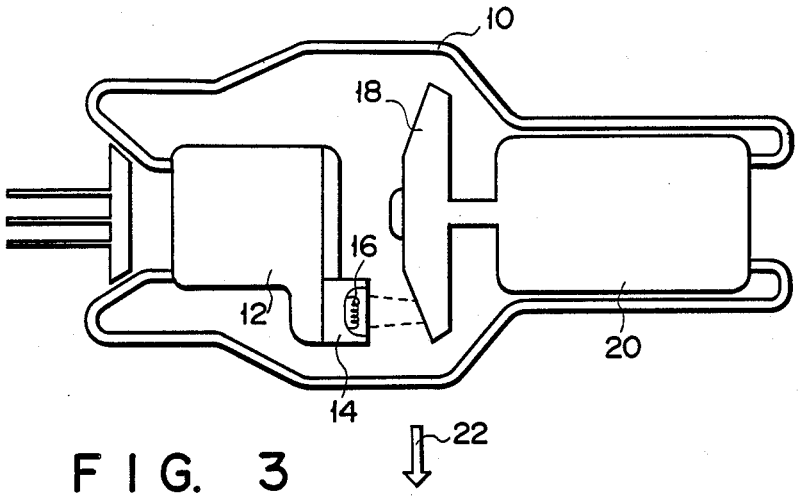
FIG. 3 is a schematic view of a rotating anode X-ray tube rotated by a driving apparatus according to the present invention.

FIG. 3 shows a rotating anode X-ray tube. Cathode sleeve 12 made of iron, nickel, or the like is located inside glass valve 10 made of hard glass. Focusing electrode (cathode) 14, which contains filament 16 composed of a tungsten coil, is located at the distal end of sleeve 12. An electron ray generated from cathode 14 is radiated onto a target surface composed of an iron-tungsten alloy formed on the surface of rotating anode 18, and X-ray 22 is generated therefrom in a direction perpendicular to the direction of radiation of the electron ray. Anode 18 has a shaft which extends in the axial direction of valve 10 and is rotated by AC motor 20.

Figure 4:
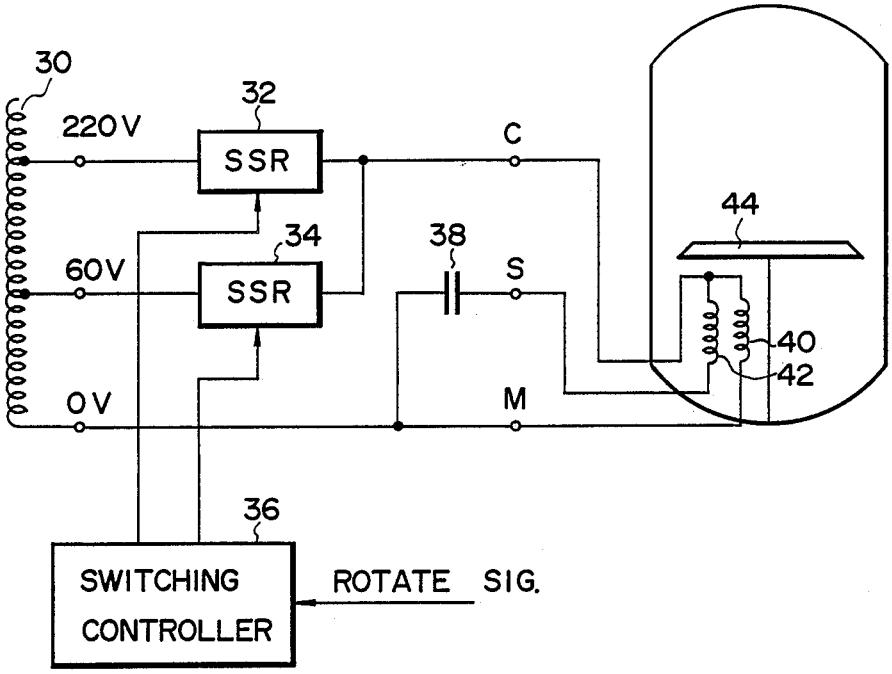
FIG. 4 is a block diagram of a first embodiment of a rotating anode driving apparatus of an X-ray tube according to the present invention.

FIG. 4 shows a circuit diagram of a first embodiment of an anode driving apparatus of such a rotating anode X-ray tube according to the present invention. Secondary (output) winding 30 of a power transformer connected to an AC power source (not shown) has two taps for outputting AC voltages having the same phase, i.e., AC voltages of 220 V and 60 V are output therefrom, respectively. These two taps are connected to common terminal C of an AC motor, respectively via switching elements 32 and 34 each made up of a solid state relay (SSR). Each of elements 32 and 34 is not limited to a SSR; any other switch having a zero crossing function (i.e., which can be turned on in synchronism with a timing at which a load, i.e., the AC voltage to be applied to the AC motor in this case, is substantially zero) can be used. As a solid state relay, an optical insulating AC zero-crossing (normally open) semiconductor relay TSS25J41S, available from TOSHIBA, may be used. This semiconductor relay comprises a light-emitting circuit, a light-receiving circuit, a firing suppression circuit (non-zero voltage), and a bidirectional thyristor (triac) connected in this order from an input side. ON/-OFF operation of elements 32 and 34 is controlled by a control signal from switching controller 36. Controller 36 switches the driving mode of anode 12 to one of an activation mode, a constant-speed rotation mode, and a braking mode, and turns on/off elements 32 and 34 in accordance with the selected mode. A rotate signal is externally supplied to controller 36 while the rotating anode is being rotated, i.e., during the activation and constant-speed rotation modes. A terminal for 0 V of winding 30 is connected to main terminal M of the AC motor and is connected to subterminal S thereof via phase shift capacitor 38. Terminal M and subterminal S are connected to one end of each of main coil 40 and subcoil 42 of the AC motor, respectively. The other ends of coil 40 and subcoil 42 are connected with each other and then connected to terminal C. In FIG. 4, reference numeral 44 denotes a rotating anode.

Figure 5:
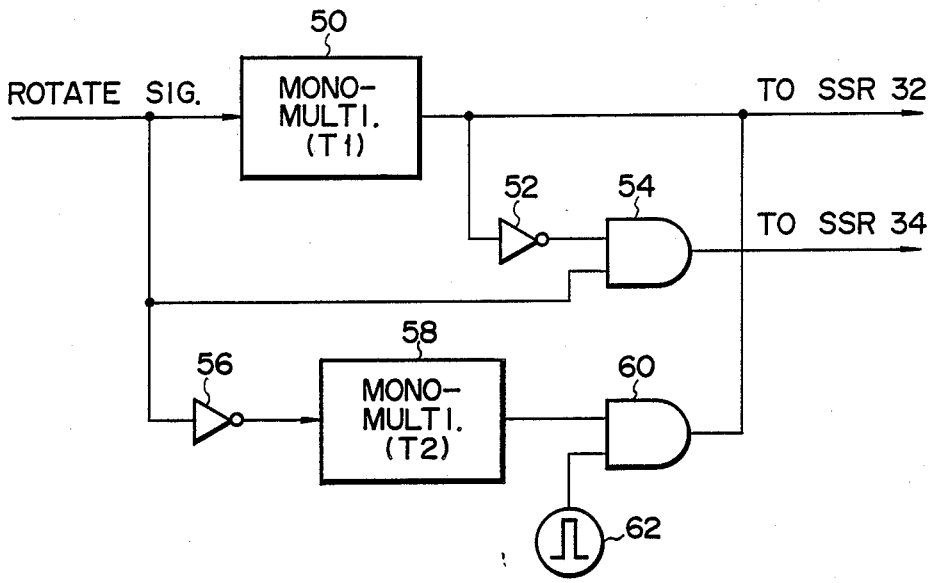
FIG. 5 is a detailed circuit diagram of the switching controller shown in FIG. 4.

FIG. 5 shows switching controller 36 in detail. A rotate signal is externally input to monostable multivibrator (time constant T1) 50, and an output therefrom is supplied as a control signal to element 32. The output from multivibrator 50 is also supplied to the first input terminal of AND gate 54 via inverter 52. This rotate signal is also supplied to the second input terminal of AND gate 54, and an output therefrom is supplied as a control signal to element 34. The rotate signal is additionally input, via inverter 56, to monostable multivibrator (time constant T2) 58, and an output therefrom is supplied to the first input terminal of AND gate 60. Clock pulse 62 with a frequency equal to that of the AC power source is supplied to the second input terminal of AND gate 60, with the output (pulse 62) therefrom also being supplied as a control signal to element 32.

Figure 6:
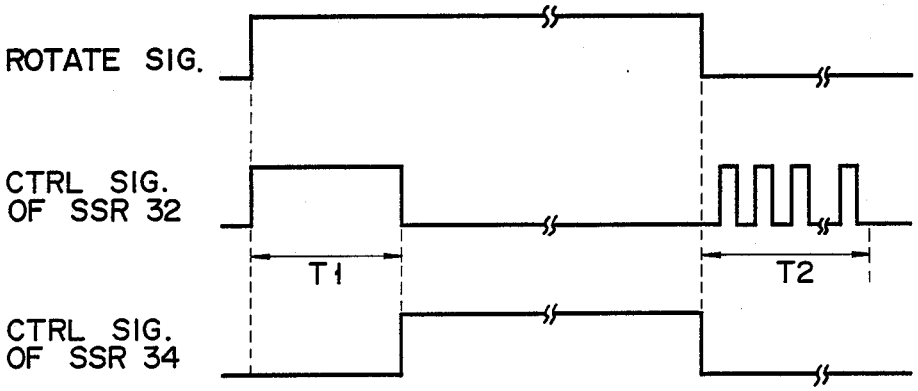
FIG. 6 is a timing chart for explaining the operation of the switching controller shown in FIG. 5.

The overall operation of the first embodiment will now be described below, with reference to FIG. 6. Controller 36 receives the rotate signal which goes to high level in synchronism with activation and returns to low level in synchronism with the end of constant-speed rotation, i.e., the start of braking. When the rotate signal rises to high level, multivibrator 50 operates in synchronism therewith and supplies a signal of high level, as a control signal, to element 32, only for predetermined time period T1. As a result, element 32 is continuously turned on only for period T1 after the rotate signal rises to high level, and a driving voltage of 220 V is applied to terminal C of the AC motor, thereby activating rotation of the AC motor. In other words, time constant T1 of multivibrator 50 represents the activation time period during which the rotational speed of anode 12 of the X-ray tube reaches a constant rotational speed from 0, and is determined by the type of the X-ray tube, i.e., in this case, time constant T1 may be varied in accordance with the type of the X-ray tube. The activation voltage (in this case, 220 V) also is determined by the type of the X-ray tube.

When an output signal from multivibrator 50 goes to low level after time constant T1 has passed, an inversion signal output from inverter 52 goes to high level. AND gate 54, which receives the inversion and rotate signals, supplies an output signal of high level, as a control signal, to element 34. Therefore, after activation is completed, element 32 is turned off, and element 34 is turned on. That is, the driving voltage of 60 V is applied to terminal C of the AC motor, so that the AC motor is rotated at a constant speed.

Figure 7:
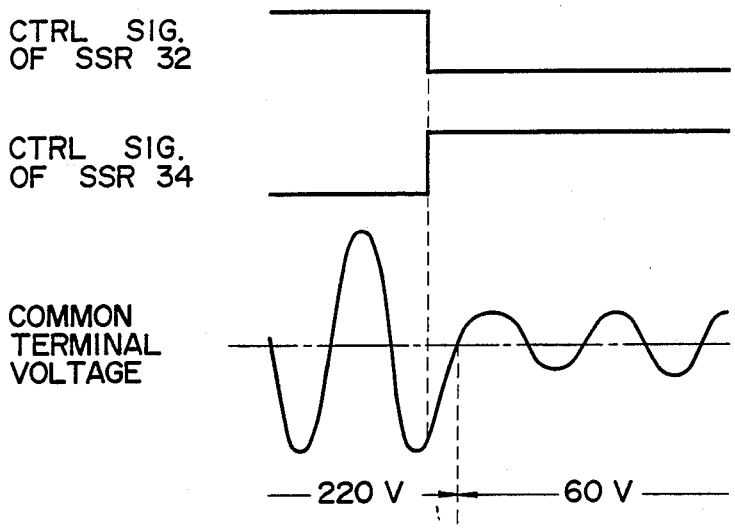
FIG. 7 is a timing chart showing an operation in which a rotation mode of a rotating anode is switched from an activation mode to a constant-speed rotation mode, in the case of the first embodiment.

Since elements 32 and 34 have a zero-crossing switching function, switching of the level of the control signal and ON/OFF switching of elements 32 and 34 are not, as is shown in FIG. 7, performed at the same time. That is, when a phase of the voltage applied to common terminal C becomes 0 after the level of the control signal supplied to elements 32 and 34 is switched, the ON/OFF state of elements 32 and 34 is switched, and the voltage applied to common terminal C is switched from 220 V to 60 V. Thus, according to this embodiment, since the AC voltage is always switched when the phase is 0, the driving voltage is smoothly switched, thereby preventing generation of a surge during switching.

Figure 8:
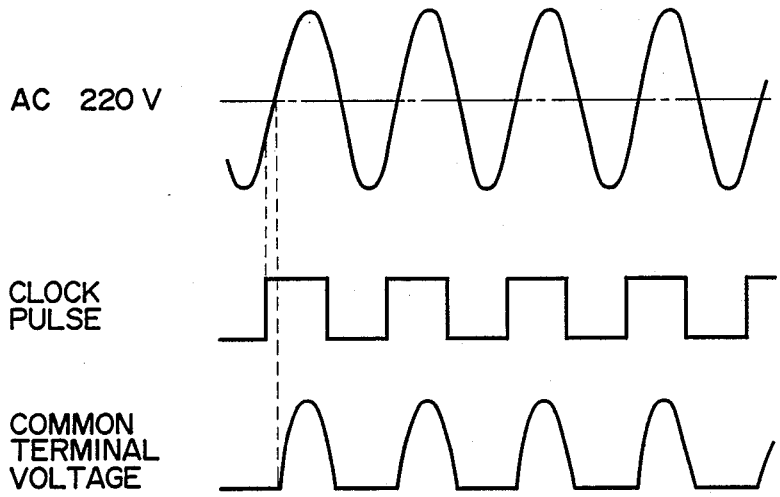
FIG. 8 is a timing chart showing an operation during the braking mode according to the first embodiment.

This constant-speed rotation mode continues while the rotate signal remains at high level. When the rotate signal goes to low level, AND gate 54 is disabled, and an output therefrom (a control signal to element 34) goes to low level. Therefore, element 34 is turned off. Since the inversion signal obtained by inverting the rotate signal by inverter 56 goes to high level, multivibrator 58 operates and outputs a signal of high level only for predetermined time period T2. Therefore, pulse 62, with the same frequency as the power source, is supplied as a control signal to element 32 only for period T2. Element 32 repeats an ON/OFF operation in synchronism with the clock pulse throughout period T2. For this reason, as is shown in FIG. 8, element 32 having the zero-crossing switching function is turned on in synchronism with a period in which a positive half wave of 220 V appears, and a half-wave rectified output of the driving voltage of 220 V is applied to common terminal C. Therefore, the AC motor is set in the braking mode, and the rotational speed thereof is gradually reduced. Braking period T2 is determined by the type of the X-ray tube. It should be noted that, with certain types of tube, it is not necessary to perform the braking operation. In the event that the braking operation is not necessary, time constant T2 of multivibrator 50 is set to 0.

As described above, according to the first embodiment, it is not the electromagnetic relays, but the switching elements having a zero-crossing switching function, that switch a voltage to be applied to the AC motor. Therefore, no arc, which would generate a surge during switching of the application voltage, is generated; thus, the creation of noise which would be introduced into other circuits, is prevented, in turn. In addition, the switching elements are not worn away or damaged by surges, and hence do not need to be replaced periodically. Moreover, since the switching element for switching the driving voltage is operated as a rectifier, so that the driving voltage is rectified to be the braking voltage, the apparatus can be made compact. Therefore, unlike in the conventional apparatus, it is not necessary to provide a separate rectifier STACK for generating a braking voltage.

Figure 9:
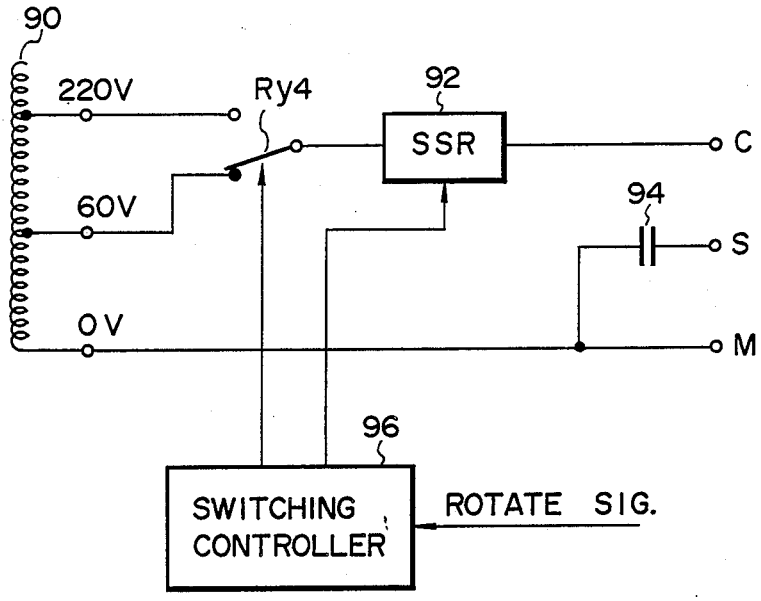
FIG. 9 is a block diagram of a second embodiment of an anode driving apparatus of a rotating anode X-ray tube according to the present invention.

FIG. 9 is a block diagram of a second embodiment. In the second embodiment, a voltage switching element is made up of relay Ry4 and an SSR while it is made up of an SSR in the first embodiment. One of two taps (from which AC voltages of 220 V and 60 V of the same phase are output as in the first embodiment, but they need not have the same phase in this embodiment) of secondary winding 90 is selected by mechanical relay Ry4 and supplied to switching element 92 made up of an SSR. Element 92 is not limited to the SSR but must have a zero-crossing switching function. ON/OFF of relay Ry4 and element 92 is controlled by control signals from switching controller 96. Controller 96 switches a driving mode of a rotating anode to one of activation, constant-speed rotation, and braking modes and turns on/off relay Ry4 and element 92 in accordance with the selected mode. A rotate signal is externally supplied to controller 96 while the rotating anode is rotated, i.e., during the activation an constant-speed rotation modes. An output from element 92 is supplied to common terminal C. A terminal for 0 V of winding 90 is connected to main terminal M and is connected to subterminal S through phase shift capacitor 94.

Figure 10:
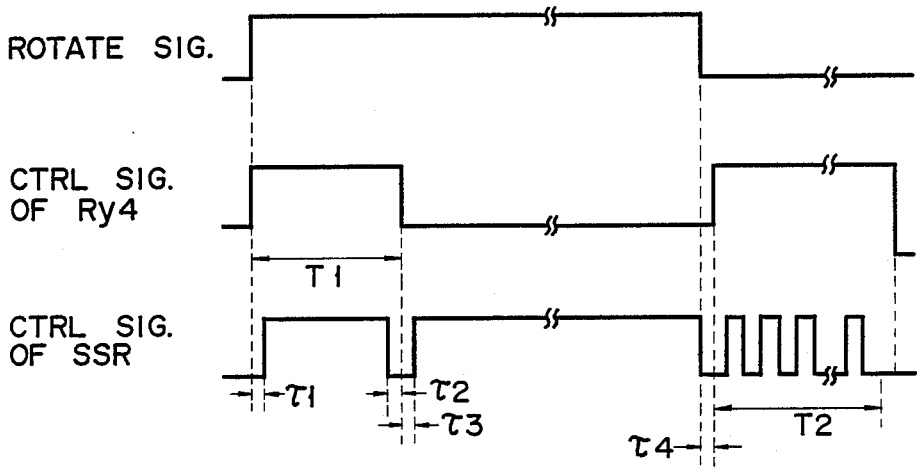
FIG. 10 is a timing chart for explaining the switching state of each switching element of the second embodiment.

The overall operation of the second embodiment will be described below with reference to FIG. 10. When the rotate signal rises to high level, controller 96 turns on relay Ry4 for only predetermined time period T1 and connects the tap of 220 V to element 92. Controller 96 turns on element 92 when short delay time $\tau 1$ has passed after the rotate signal rises to high level. For this reason, since element 92 is in an OFF state when relay Ry4 is turned on, generation of a surge can be prevented. Therefore, a driving voltage of 220 V is applied to terminal C to activate rotation of an AC motor. Controller 96 turns off element 92 short time $\tau 2$ before ON period T1 of relay Ry4 is completed. In response to turn off of element 92, application of the driving voltage of 220 V to terminal C is stopped and activation is completed. In this case, since element 92 is already turned off when relay Ry4 is turned off, generation of a surge can be prevented. These timings are controlled by a delay circuit included in switching controller 96. Note that in this case, the activation period is, strictly speaking, T1 - $\tau 1$ - $\tau 2$.

Controller 96 turns on element 92 again when short delay time $\tau 3$ has passed after relay Ry4 is turned off. At this time, since relay Ry4 is connected to the tap of 60 V, the driving voltage of 60 V is applied to terminal C, so that the AC motor is rotated at a constant speed. This constant speed rotation continues while the rotate signal is at high level.

When the rotate signal goes to low level, in order to prevent generation of a surge, controller 96 turns off element 92, then turns on relay Ry4 after small delay time $\tau 4$ has passed after turn off of element 92 and connects the tap of 220 V to element 92. Thereafter, controller 96 supplies a clock pulse having the same frequency as that of the power source to element 92 as a control signal for only predetermined time period T2. Therefore, element 92 repeats a zero-crossing switching operation in synchronism with the clock pulse throughout period T2. For this reason, as in the case shown in FIG. 8, element 92 is turned on in synchronism with a period in which a positive half wave of 220 V appears, and a half wave rectified output of the driving voltage of 220 V is applied to terminal C. Therefore, the AC motor is set in the braking mode, and its rotational speed is gradually reduced. When braking period T2 is completed, controller 96 turns off relay Ry4 after delay time $\tau 5$ has passed.

As has been described above, according to the second embodiment, although a mechanical relay is used for switching the driving voltage, the switching element connected in series to the relay is always turned off before switching the relay. Therefore, generation of a surge can be prevented. In addition, since the mechanical relay is used to switch the driving voltage, the taps of the transformer need not have the same phase.

This invention is not limited to the above mentioned embodiments. Various changes and modifications may be made within the spirit and scope of this invention. For example, the details of the rotating anode X-ray tube are described for only examples.

What is claimed is:

1. An anode driving apparatus of an X-ray tube having a rotating anode, comprising:

rotating means for rotating said rotating anode;

power source means for generating a first AC voltage for activation and a second AC voltage for constant speed rotation;

zero-crossing switching means connected between said power source means and said rotating means; and control means for switching said zero-crossing switching means in a predetermined order, to sequentially apply the first and second AC voltages to said rotating means.

2. An apparatus according to claim 1, in which said zero-crossing switching means comprises rectifying means for rectifying the first AC voltage to generate a braking voltage for deenergizing said rotating means, and said control means comprises applying means for applying the braking voltage to said rotating means.

3. An anode driving apparatus of an X-ray tube having a rotating anode, comprising:

rotating means for rotating said rotating anode;

power source means for generating a first AC voltage for activation and a second AC voltage, for constant-speed rotation, having the same phase as that of the first AC voltage;

first and second zero-crossing switching means having input terminals for respectively receiving the first and second AC voltages and having output terminals commonly connected to said rotating means; and control means for sequentially energizing said first and second zero-crossing switching means, to sequentially apply the first and second AC voltages to said rotating means.

4. An apparatus according to claim 3, in which said control means comprises means for periodically turning on/off said first zero-crossing switching means, at the same frequency as that of the first AC voltage, to half-wave rectify the first AC voltage, thereby generating a braking voltage for deenergizing said rotating means.

5. An apparatus according to claim 4, in which each of said first and second zero-crossing switching means comprises a solid state relay.

6. An anode driving apparatus of an X-ray tube having a rotating anode, comprising:

rotating means for rotating said rotating anode;

power source means for generating a first AC voltage for activation and a second AC voltage for constant speed rotation;

switching means for receiving the first and second AC voltages and for outputting one of the first and second AC voltages to said rotating means;

zero-crossing switching means connected between said switching means and said rotating means; and control means for controlling said switching means and said zero-crossing switching means, in a predetermined order, to sequentially apply the first and second AC voltages to said rotating means, said switching means being always switched after said zero-crossing switching means is turned off.

7. An apparatus according to claim 6, in which said control means periodically turns on/off said zero-crossing switching means, at the same frequency as that of the first AC voltage, to half-wave rectify the first AC voltage, thereby generating a braking voltage for deenergizing said rotating means.

8. An apparatus according to claim 6, in which said zero-crossing switching means comprises a solid state relay.

* * * * *